United States Patent [19]

Lavielle

[11] Patent Number: 4,514,882

[45] Date of Patent: May 7, 1985

[54] DEVICE FOR RETAINING IN SIDE-BY-SIDE RELATIONSHIP FLEXIBLE TYING MEANS SUCH AS SHOELACES

[76] Inventor: Christian Lavielle, 59 Chemin de Suzon Résidence du Grand-Chêne, 33400 Talence, France

[21] Appl. No.: 545,505

[22] Filed: Oct. 26, 1983

[51] Int. Cl.[3] ..... B65D 63/00; F16G 11/00

[52] U.S. Cl. ..... 24/16 PB; 24/17 AP; 24/30.5 P; 24/117; 292/318

[58] Field of Search ..... 24/16 PB, 17 B, 17 AP, 24/30.5 R, 30.5 P, 30.5 S, 117 R; 292/318, 319, 321, 322; 248/74.3, 74.5

[56] References Cited

U.S. PATENT DOCUMENTS

| | | | |
|---|---|---|---|
| 1,730,462 | 10/1929 | Jaques . | |
| 2,818,871 | 1/1958 | Beaudry | 24/16 PB |
| 3,103,725 | 9/1963 | Robb et al. | 24/117 R |
| 3,157,421 | 11/1964 | Nierhaus | 292/322 |
| 3,418,733 | 12/1968 | Tyrrell, Sr. et al. | 24/117 R |
| 3,457,358 | 7/1969 | Brumfield | 24/30.5 R |
| 3,473,198 | 10/1969 | Meier | 24/119 |
| 3,501,814 | 3/1970 | Anderson et al. | 24/16 PB |
| 3,571,861 | 3/1971 | Olson | 24/30.5 P |
| 4,042,267 | 8/1977 | Clinch | 292/318 |
| 4,296,529 | 10/1981 | Brown | 24/30.5 P |

FOREIGN PATENT DOCUMENTS

| | | | |
|---|---|---|---|
| 53503 | 3/1946 | France . | |
| 1412518 | 8/1965 | France | 24/30.5 P |
| 2082584 | 12/1971 | France . | |
| 2256487 | 7/1975 | France . | |

*Primary Examiner*—Victor N. Sakran

*Attorney, Agent, or Firm*—Schwartz, Jeffery, Schwaab, Mack, Blumenthal & Koch

[57] ABSTRACT

A device for retaining in side-by-side relationship flexible tying means such as shoelaces comprises two relatively rigid clamping members and a relatively flexible linking member joining the clamping members. The linking member is adapted to permit the clamping members to be folded so as to lie one against the other so as to firmly retain the flexible tying means in side-by-side relationship between them. Means are provided for resistantly locking together the clamping members in the position in which they are folded against one another. The device is applicable in particular to the self-service retailing of shoes.

6 Claims, 3 Drawing Figures

DEVICE FOR RETAINING IN SIDE-BY-SIDE RELATIONSHIP FLEXIBLE TYING MEANS SUCH AS SHOELACES

BACKGROUND OF THE INVENTION

1. Field of the Invention

The present invention concerns a device for retaining in side-by-side relationship flexible tying means and more particularly, but not exclusively, for temporarily retaining, as a theft prevention measure, the laces of the shoes of a pair previously inserted in the laceholes of the shoes, in particular for shoes offered for sale in stores or store departments of the self-service kind.

2. Description of the Prior Art

In this kind of retailing operation, shoes are displayed in pairs, the two shoes of each pair being attached together by means of a nylon thread. The shoes are placed either loose in a bin or on shelving or other forms of display unit and, with no sales staff present, customers choose, take down and try on for themselves the design which interests them.

By virtue of the absence of sales staff and the lack of continuous surveillance, it is very frequently the case that shoelaces are stolen, as they are not attached to the shoes. This significantly reduces turnover since the pairs of shoes without laces are simply ignored by customers.

The theft of the shoelaces also means that the pairs of shoes without laces must be constantly or periodically removed from display, using valuable time and tying up staff.

The object of the present invention is to overcome these disadvantages by offering a system which is capable of preventing the theft of shoelaces while enabling shoes to be displayed in pairs with their laces.

SUMMARY OF THE INVENTION

The invention consists in a device for retaining, in side-by-side relationship, flexible tying means, such as shoelaces, comprising two relatively rigid clamping members, a relatively flexible linking member joining said clamping members and adapted to permit said clamping members to be folded so as to lie one against the other so as to firmly retain said flexible tying means in side-by-side relationship between them, and means for resistantly locking together said clamping members in the position in which they are folded against one another.

A device of this kind enables the shoes of a pair to be tried on since it retains the four free ends of the shoelaces, after they have been threaded through all or some of the laceholes in both shoes, but prevents the removal of the laces since their ends are clamped in the device.

For preference, means are provided for locking together the two clamping members of the device so that the latter must be at least partially destroyed, using an appropriate instrument or tool, for example by cutting or nicking part of the device with a pair of scissors.

As a result, the ill-intentioned customer is dissuaded from making off with the shoelaces since they cannot be removed by simply pulling on them and the customer is not normally equipped with the appropriate tool for releasing the device.

The mating surfaces between which the laces are trapped are for preference equipped with notches or projections, the shapes, sizes and dispositions of which may vary widely, in order to strongly retain the laces and to prevent their extraction, without in any way damaging the laces.

Also, the device may with advantage provide a support for a size indication, for example, eliminating the need to otherwise label the shoes to this effect.

Other objects and advantages will appear from the following description of an example of the invention, when considered in connection with the accompanying drawing, and the novel features will be particularly pointed out in the appended claims.

Figure 1:
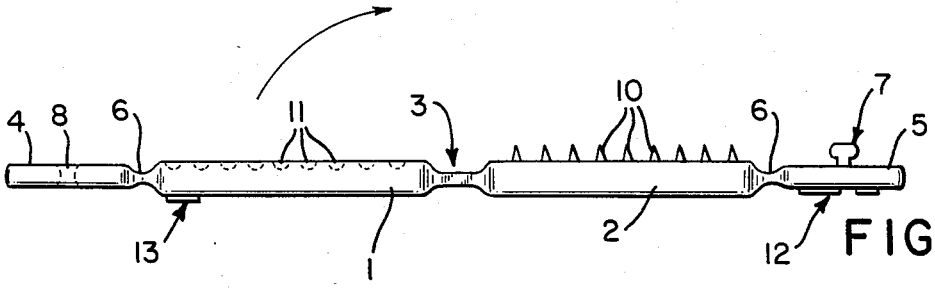
FIG. 1 is a view in elevation of a device in accordance with the invention in a deployed state.
Figure 2:
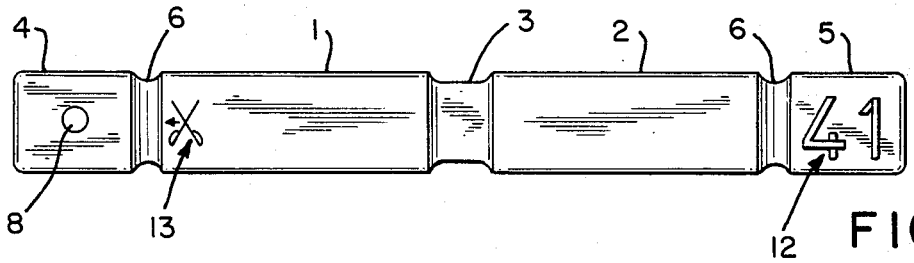
FIG. 2 is a view from below of the device as shown in FIG. 1.

The device shown in the drawing comprises two rectangular members 1 and 2, of substantially the same dimensions, made of a relatively rigid material such as an injection-molded plastics material, for example.

The two members 1 and 2 are linked by a flexible linking member 3 integral with members 1 and 2, being of reduced thickness and width, for example.

The two ends of the combination 1-2-3 are extended by two locking members 4 and 5 similarly linked to members 1-2 by weaker severable linking members 6.

The extensions 4 and 5 are equipped with a system for locking the members 1 and 2 in the position in which they are folded against one another, consisting in the embodiment shown of a widened head pin 7 on one surface of the extension 5 and a hole 8 for receiving and retaining the pin 7 correspondingly located on the extension 4.

Figure 3:
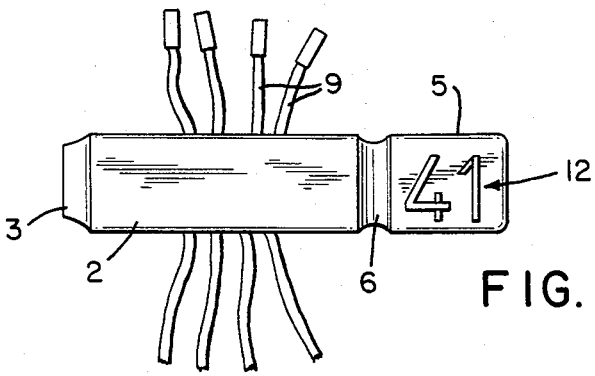
FIG. 3 shows the device as shown in FIG. 2 folded so as to trap a pair of laces.

On the mating surfaces of the members 1 and 2, being those surfaces which face one another when the assembly is folded around the linking member 3 as shown by the arrow, there are preferably provided means for gripping the tying means such as shoelaces 9, for example, trapped between the members 1 and 2 (FIG. 3).

In the embodiment shown, these means comprise pins 10 carried by one of the members and cooperating with recesses 11 on the other member corresponding to these pins 10. The shapes, sizes and dispositions of the pins 10 and recesses 11 may naturally vary within wide limits. The pins 10 are preferably pointed so as to better penetrate the laces 9.

The external surfaces of the device (those which are visible when the device is folded) advantageously carry symbols such as an indication 12 of the size on the extension 5, for example, or a symbolic representation 13 of scissors in the vicinity of one of the linking members 6, indicating where the cut must be made to release the laces 9.

Fitting the device is very simple and very quick.

The ends of the laces 9 are grouped together and clamped between the members 1 and 2 folded together and held in this position by force-fitting the pin 7 into the hole 8. This locks the device, which can no longer be opened manually, the shapes and dimensions of the pin 7 and the hole 8 being determined accordingly.

Before the laces 9 are trapped in the device, they are threaded through all or some of the laceholes in the pair of shoes so that the shoes and laces are all fastened together.

The laces 9 are essentially retained by the pins 10, certain of which pass through the laces 9, preventing the laces being extracted from the device by pulling on them.

The material of the device is selected so as to offer adequate rigidity in combination with a certain degree of flexibility, in particular in the vicinity of the locking members 7 and 8, the entire device being with advantage molded in a single manufacturing operation.

To release the trapped laces (FIG. 3) it is merely necessary to cut the linking member 6 with scissors after which it is easy to pull apart members 1 and 2 by hand.

The means for gripping and retaining the laces between the two members 1 and 2 may naturally vary in terms of structure, shape, size and disposition.

By way of a variation, the pins 10 and recesses 11 could be replaced by ribs or projections transverse to the laces and cooperating with corresponding projections or grooves on the surface of the opposite member. Any other means of achieving the same result may be utilized without departing from the scope of the invention.

It will be understood that various changes in the details, materials and arrangements of parts, which have been herein described and illustrated in order to explain the nature of the invention, may be made by those skilled in the art within the principle and scope of the invention as expressed in the appended claims. For example, the shapes and sizes of the members 1 and 2, the flexible linking member between them, and the means for locking these members in the position in which they retain the flexible tying means may all be varied, as may the material utilized. It should also be noted that the invention is applicable to the temporary retaining in side-by-side relationship of a number of flexible tying means, whether shoelaces, strings or other similar means, irrespective of their number and whether or not they form part of an object of any kind whatsoever.

I claim:

1. A device for retaining in side-by-side relationship flexible tying means such as shoelaces comprising:

a pair of relatively rigid clamping members formed of a plastic material, a relatively flexible linking member comprising a hinge section of reduced dimension integrally formed with said clamping members and joining said clamping members in such a manner as to permit said clamping members to be folded so as to lie one against the other for firmly retaining said flexible tying means in side-by-side relationship therebetween, gripping means on the mating surfaces of said clamping members comprising pins on one of said surfaces and corresponding cooperating depressions on the other of said surfaces, said pins being of sufficient size and number as to be able to engage and retain said flexible tying means placed between said clamping members, means for locking said clamping members together, said locking means being such as to require at least partial destruction of said device for removal of said tying means from between said clamping members, and said clamping members including severable portions of reduced thickness so as to enable severance of said frangible portions for opening said device and releasing said flexible tying means for use.

2. A device according to claim 1, manufactured in one piece from a plastics material by means of a single molding operation.

3. A device according to claim 1, wherein said clamping members have respective extensions on which are formed said locking means.

4. A device according to claim 3, wherein said locking means comprise a pin with a widened head on one of said extensions and a hole in the other of said extensions into which said pin is adapted to be force-fitted.

5. A device according to claim 3, wherein said extensions are linked to the respective clamping members by said severable portions.

6. A device according to claim 1, wherein the surfaces of said clamping members which are visible with said clamping members in the position in which they are folded against one another carry information in the form of symbols or other markings.

* * * * *